US007766217B2

(12) United States Patent
Sylvain

(10) Patent No.: US 7,766,217 B2
(45) Date of Patent: Aug. 3, 2010

(54) METHOD FOR MANAGING A CONTINUOUS IN-LINE METAL STRIP PROCESSING INSTALLATION, AND INSTALLATION FOR IMPLEMENTING THIS METHOD

(75) Inventor: Daniel Sylvain, Paris (FR)

(73) Assignee: Siemens VAI Metals Technologies SAS, Saint Chamond (FR)

( * ) Notice: Subject to any disclaimer, the term of this patent is extended or adjusted under 35 U.S.C. 154(b) by 911 days.

(21) Appl. No.: 10/560,361

(22) PCT Filed: Jun. 11, 2004

(86) PCT No.: PCT/FR2004/050273

§ 371 (c)(1),
(2), (4) Date: Dec. 12, 2005

(87) PCT Pub. No.: WO2004/110663

PCT Pub. Date: Dec. 23, 2004

(65) Prior Publication Data

US 2006/0124696 A1 Jun. 15, 2006

(30) Foreign Application Priority Data

Jun. 12, 2003 (FR) ..... 03 50213

(51) Int. Cl.
*B23K 31/02* (2006.01)

(52) U.S. Cl. ..... 228/144

(58) Field of Classification Search ..... 228/144
See application file for complete search history.

(56) References Cited

U.S. PATENT DOCUMENTS 2,067,192 A 1/1937 Hudson
2,662,271 A 12/1953 Greenberger
3,365,144 A 1/1968 Daub
4,513,490 A * 4/1985 Sendzimir ..... 29/527.6
5,182,428 A 1/1993 Jack et al.

FOREIGN PATENT DOCUMENTS

FR 2 318 688 A 2/1977
FR 2 585 486 A 1/1987
JP 4228281 A 8/1992
JP 11156416 A 6/1999

* cited by examiner

*Primary Examiner*—Jessica L Ward
*Assistant Examiner*—Nicholas P D'Aniello
(74) *Attorney, Agent, or Firm*—Laurence A. Greenberg; Werner H. Stemer; Ralph E. Locher

(57) ABSTRACT

The invention relates to a new method for managing the feeding of a new coil into a continuous inline processing plant of a band-type product, in particular for passing short coils through the production line.

According to the invention, the global duration for performing the general connection process of a new coil (11') is divided into at least two time periods ($T_1$, $T_3$) realized in at least two successive portions (3, 4) of the inlet section (1) of the plant and the junction cycle is broken down into two separate phases $S_1$, $S_2$ between which a variable band length is set aside in at least one intermediate accumulator (5) in order to provide a time interval ($T_2$) of variable duration between said time periods of the connection process.

The invention applies especially to continuous etching lines of steel bands.

33 Claims, 3 Drawing Sheets

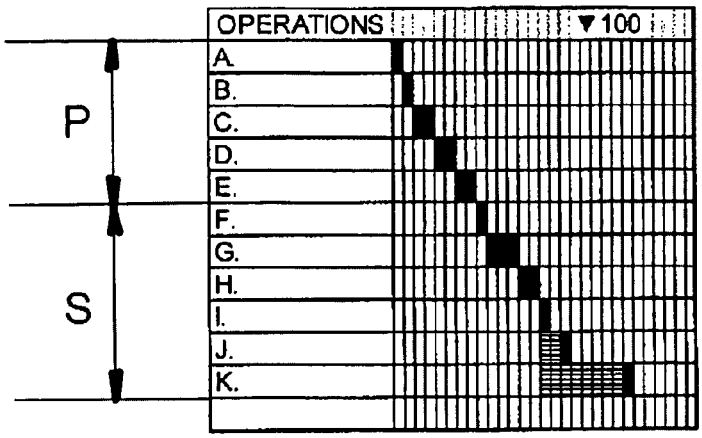
- fig. 1 -
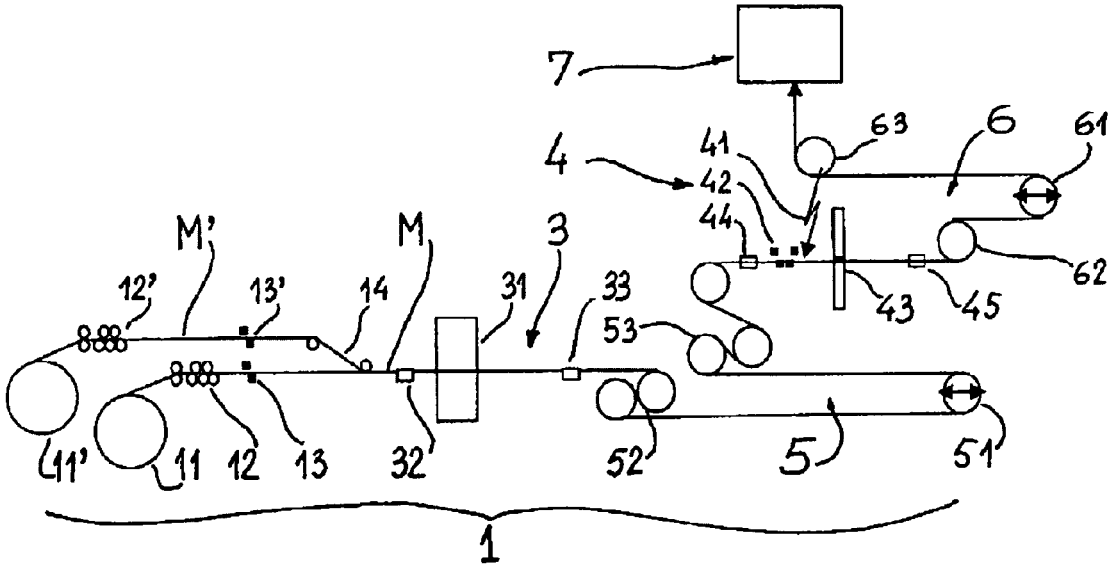
- fig.2 -

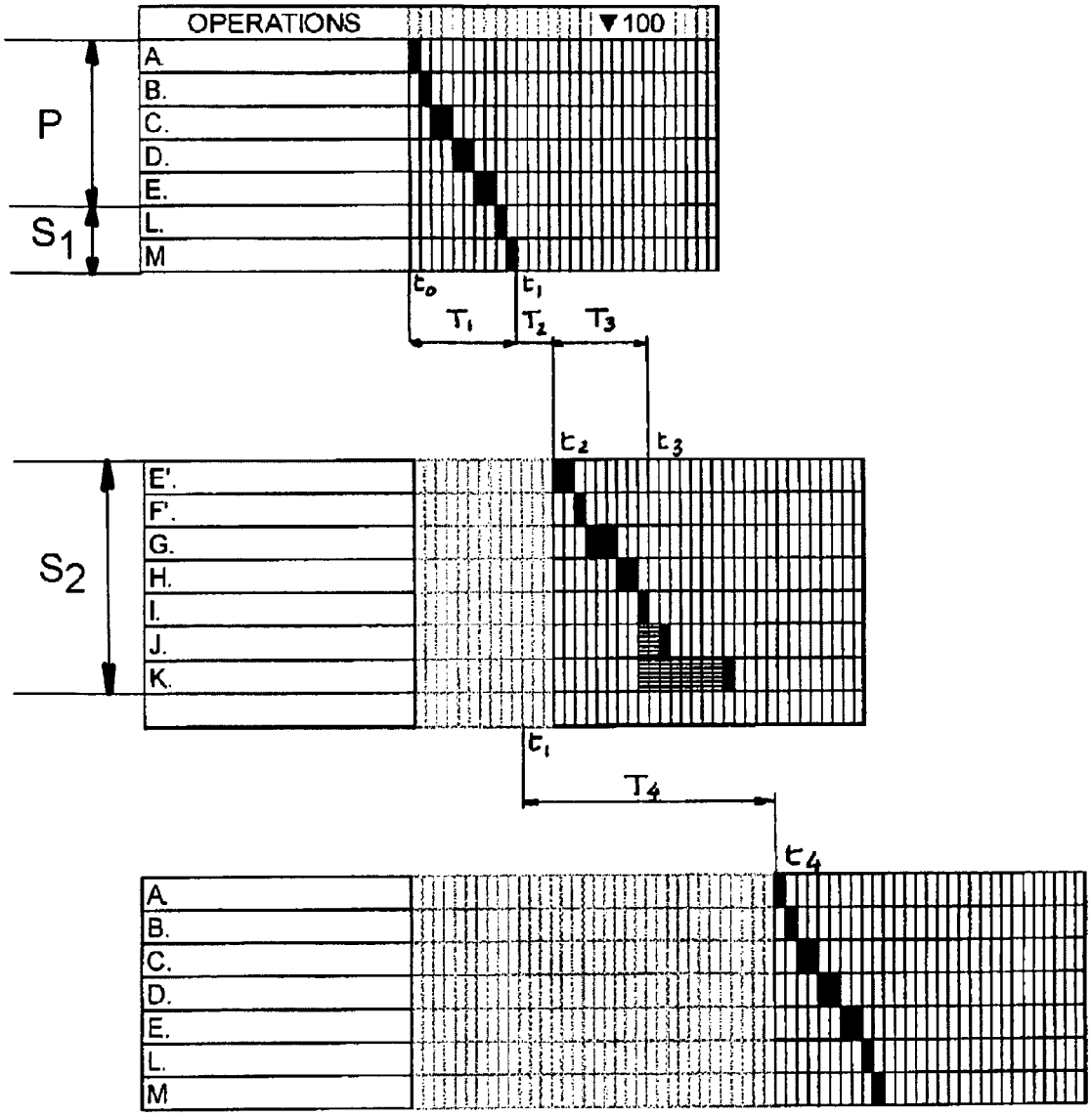
- fig. 3 -

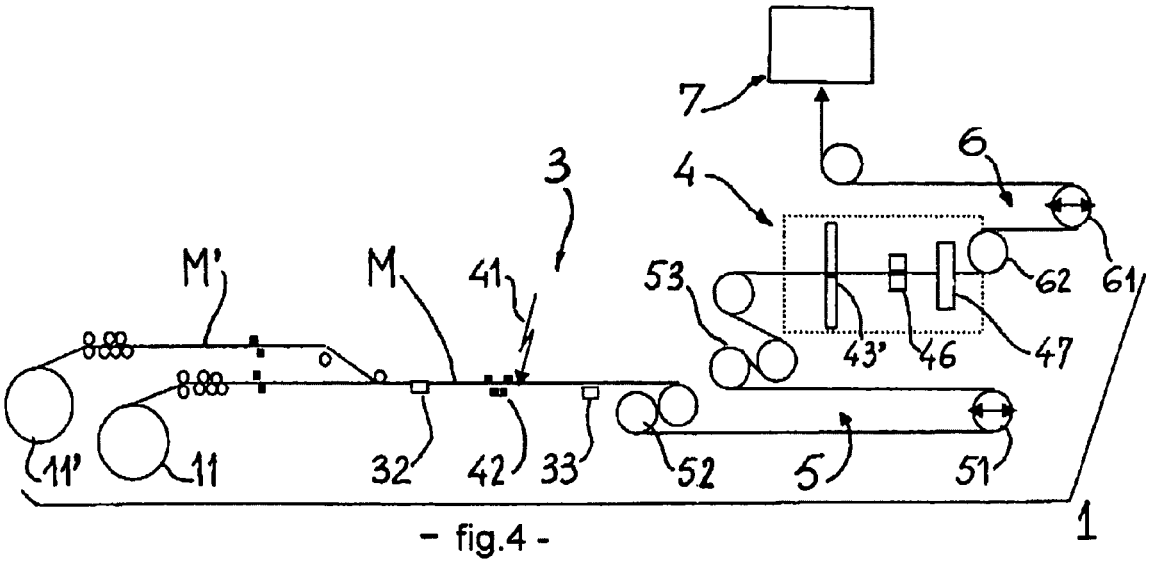
- fig.4 -
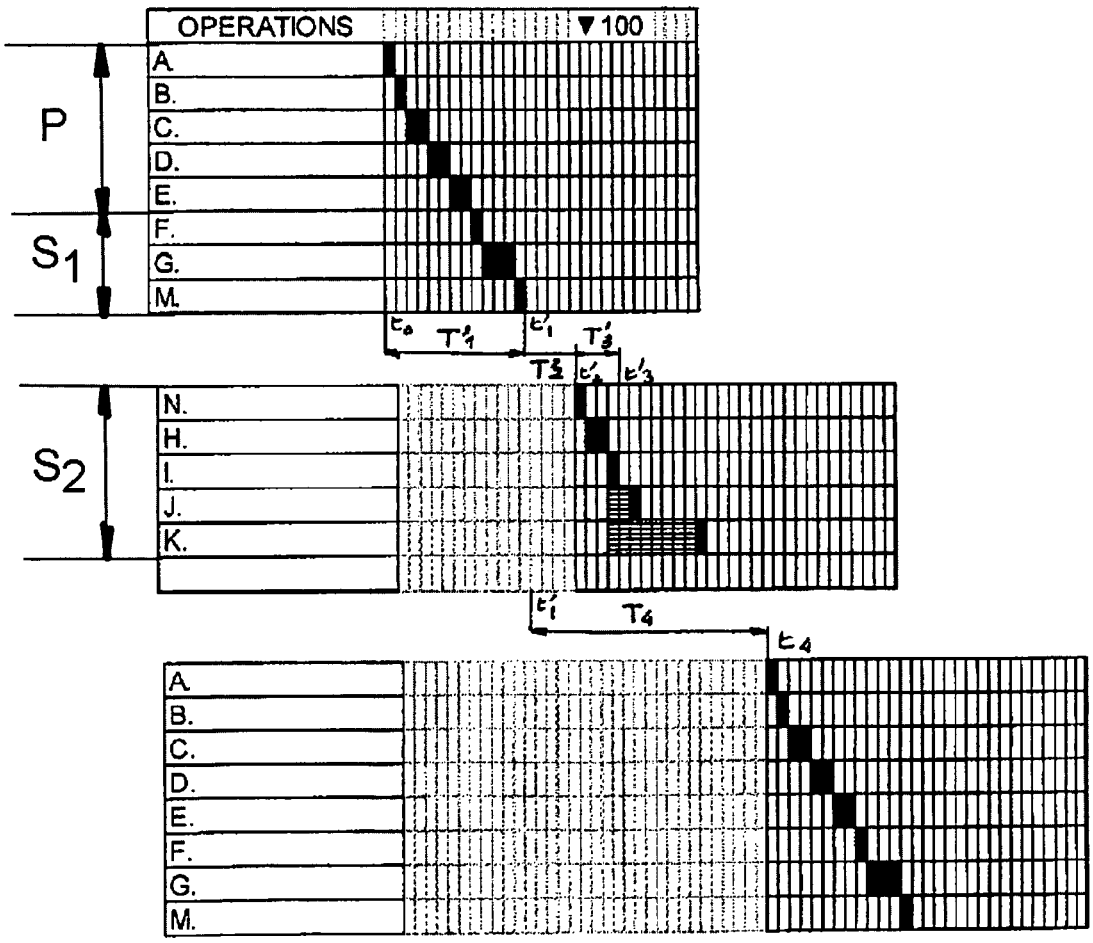
- fig. 5 -

METHOD FOR MANAGING A CONTINUOUS IN-LINE METAL STRIP PROCESSING INSTALLATION, AND INSTALLATION FOR IMPLEMENTING THIS METHOD

CROSS-REFERENCE TO RELATED APPLICATION

This application is a National Stage entry of International Application Number PCT/FR2004/050273, filed Jun. 11, 2004. The disclosure of the prior application is hereby incorporated herein in its entirety by reference.

The invention relates to a method for managing the feeding of a new coil into a continuous in-line processing plant for a band-type product and also covers an inproved processing plant for implementing this method.

It is known that the manufacturing process of steel products, in particular metal bands, calls for a series of successive treatments. Generally, after the preparation of steel and the casting thereof into moulds or by continuous casting, the product is hot rolled, wound into a coil and then subjected to diverse operations, generally annealing, etching which enables to eliminate scale, and hot-rolling which may be conducted either on a reversible mill or on a tandem mill. Then, the band thus rolled may undergo various treatments, for example degreasing, annealing, etching, surface coating, etc.

The evolution of technology leads more and more to gathering into a continuous line some treatments which was previously carried out in separate plants, the band being wound into a coil at the end of a treatment to be moved to the next plant for a subsequent treatment.

The band to be processed, supplied in the form of coils placed after one another on an uncoiler, passes successively through the different sections of the plant. To realise the continuous treatment, at the end of the uncoiling of a coil, it is thus necessary to fasten the tail thereof, i.e. its downstream end in the running direction, to the head of the next coil, i.e. the upstream end in the running direction. To resist the loads applied to the band when running through the successive sections of the plant, this junction is most often realised by electric welding, in particular in the case of steel bands.

For instance, both portions to be welded may be applied to one another but this causes an excessive thickness and butt-welding by flash welding is generally preferred.

In all cases, both ends, respectively the downstream and the upstream ends of both successive bands to be welded, should be perfectly parallel and are therefore cut off before welding by means which may be integrated to the welding plant.

However, since coils from the hot-rolling process are treated, the band should firstly undergo a cropping operation in order to eliminate the head and the tail of the coil which are not rectilinear and may exhibit certain defects.

Hence, the connection process of two consecutive bands comprises, on the one hand, the preparing operations of the ends of both bands and, on the other hand, the joining operations themselves. All the operations are therefore conducted in successive steps in apparatus which are generally gathered in an inlet section of the associated plant which most often comprises two unwinders carrying respectively the coil at the end of the unwinding process and the new coil to be processed.

First, after completion of the unwinding of the first coil, it is necessary to crop the tail thereof in an inlet shearing tool, then to position the band in the welding machine and shear the downstream end thereof. Meanwhile, the second coil has started to be unwound, from the second unwinder and the head thereof has been cropped by means of an inlet shearing tool. Then the new band is inserted into the welding machine, positioned and shorn.

Advantageously, the ends of both bands are shorn at the same time in the welding machine which, to that effect, is associated with means for positioning and clamping the ends of both bands to be welded and with means for shearing both ends along two perfectly parallel lines. Then, both ends are brought towards one another for the welding cycle, in particular the flash welding cycle, by passing an electric current between both bands to be welded.

Therefore, the apparatus placed in the feeding section of the plant conduct a series of operations which may be divided into two successive cycles:

First a preparation cycle including cropping the tail of the first band and positioning this latter into the welding machine, and after inserting the next band, cropping its head and positioning it in the welding machine.

Then, the junction cycle itself including shearing the ends of both bands to form two parallel facing edges, bringing them closer to one another, welding them and finishing the welded spot.

Obviously, all these operations require a period of time during which the running of the band must be stopped or, at least, slowed down to a minimum speed.

Indeed, if the bands may be cropped and shorn while running by means of a flying shearing tool, the positioning of both ends to be welded and the welding operation normally require a complete stoppage.

But, in most continuous on-line processing plants, the running of the band must be conducted permanently.

In particular, it is the case for the plants currently used in continuous on-line etching of steel bands. Generally speaking, such a line comprises successively an annealing furnace and an etching plant for eliminating the scale which is most often formed by a series of tanks filled with acid wherein the band is immersed. Obviously, other apparatus may be necessary, for instance a shot peening type descaling device placed before the etching tanks in order to promote chemical etching.

The normal running speed of the band in the acid tanks is generally very high and may reach, for instance, 400 m/mn. But, as seen above, the running of the band must be stopped periodically in the inlet section to enable the junction operations of the tail of a coil with the head of the following coil.

Since the etching intensity depends on the dwelling time of the band in acid, it is necessary that the running speed in the tanks remains substantially constant. Consequently, between the inlet section and the treatment section, for instance an etching section, an accumulation device is interposed which is filled beforehand with a band length set aside in order to carry on the running of the band through the processing section at normal speed during the stoppage time in the inlet section for the junction of both successive bands.

Similarly, the plant ends with an outlet section including at least one winder of the band as a coil. The length wound being obviously limited, at the end of the winding of a coil, it is necessary to cut the end thereof and to engage the next section of the band on another winder to enable the outlet of the coil wound. These operations require a certain stoppage time of the running, during which the etching cycle must be carried on.

It is why a downstream section must be located between the processing section and the outlet section in order to set aside the band length processed at normal speed during the outlet time of a wound coil.

Generally speaking, a continuous on-line processing plant, in particular for the etching cycle of steel bands, comprises successively, in the running direction of the band, an inlet section, an upstream accumulator, a processing section, a downstream section and an outlet section. At least, each upstream accumulators and downstream accumulator has an accumulation capacity corresponding to the band length running at normal speed in the processing section, respectively during the stoppage time in the inlet section for connecting the head of a new coil to the tail of the previous coil and during the stoppage time in the outlet section for the outlet of the wound coil.

As stated above, the connection between two consecutive bands requires a series of operations carried out by the different items of equipment of the inlet section.

By way of example, FIG. 1 is a diagram indicating, in abscissa, the times necessary to the successive steps of the general connection process between the tail of a coil at the end of the unwinding and the head of a new coil. For instance, these steps, referred to as A to K, are as follows:

A: stopping of the coil when completely unwound in the inlet section. The running speed being high, for instance 400 m/mn, the stoppage time may be of the order of 5 seconds as indicated in the diagram.

B: Cutting the tail of the band when completely unwound for cropping.

C: Positioning the tail of the first band in the welding machine.

D: Introduction of the next band from the second unwinder. This operation involves engaging the head of the next coil into the inlet equipment and may thus require some time, for instance 10 seconds, as indicated in the diagram. Obviously, the head of the next coil must be cropped, but this operation may be carried out beforehand. Each unwinder may be associated with an inlet shearing tool.

E: Positioning the next band into the welding machine, for instance, by means of lateral inlet guides.

In the diagram, it can be seen that operations C, D, E may each require around 10 seconds.

F: Shearing the facing ends of both bands. As specified, the facing edges of both successive bands must be rectilinear and perfectly parallel, in particular for a flash welding cycle. In this view, it is usual to use double shear which enables to shear both facing edges on each sides of the welding apparatus at the same time. This operation may therefore be fast and require, for instance, 5 seconds.

G: Welding both facing edges. This operation depends on the welding method but may require 15 seconds in average.

H: Finishing the weld, in particular if it is required to have an excessive thickness. Indeed it is interesting to conduct a flash welding cycle but it is known that a flange appears which may deteriorate the rolling cylinders. This flange should therefore be planed off. As the case may be, such operation could take place either in the welding machine itself or slightly downstream thereof and, in that case, the welded junction should be moved from the welding machine to the planing machine.

The time necessary to the finishing operations may be of the order of 10 seconds.

I: Restoring the normal running speed. This speed being high, a certain acceleration time is involved, which may be estimated around 5 seconds.

The diagram of FIG. 1 shows that the non-productive time from the beginning of speed reduction until the speed is back to its normal value exceeds 1 minute.

Moreover, certain additional operations may be necessary in certain cases. For instance, after the welding step, a step J consisting in notching the ends of the welded portion may last 10 seconds and a step K for annealing the welded spot may last 40 seconds. Both these steps may be realised at the same time before accelerating the band to return to the normal speed.

According to the diagram of FIG. 1, the global time during which the running should be stopped in the inlet section, may then be comprised between 75 and 115 seconds.

However, this diagram shows two successive operating cycles which are realised by different items of equipment: first of all, a first preparation cycle P, which corresponds hence to the steps A to E, includes the stoppage of the running process, the cropping of the ends of both bands and the positioning thereof in the welding machine; and, then, a second junction cycle S properly speaking, which corresponds hence to the operations F to I with, possibly, the steps J and K, includes the shearing of both facing edges of both bands, the welding thereof, the finishing of the welded sport and the return to the normal speed.

Obviously, the diagram of FIG. 1 is only an example and other operations might be added to the junction process, but in all cases, the stoppage idle time in order to join both bands remains between 1 minute and 1.30 minute.

Still, as seen above, the normal running speed is rather high, for instance of the order of 400 m/mn, and should remain substantially constant as far as possible. The upstream accumulator should therefore have a capacity comprised between 400 and 600 meters so that the band length set aside supplies the processing section during the stoppage time in the inlet section.

Such accumulators are extremely cumbersome and costly but however their usage remains profitable for significant productions.

Consequently, for some years, numerous plants operating in continuous line have been realised, not only for the etching cycle but for other operations such as cold-rolling or surface coating.

However, for some time, needs of the customers have evolved and periodically require modifications of the factory load plan, the composition of the steel and the dimensions of the bands produced may vary rather often.

As just seen above, a continuous inline processing plant is fitted in its inlet section with means enabling to realise the connection between successive coils without stopping the running cycle in the processing section. It is therefore possible to process bands successively with different structural and dimensional features by welding them one after the other. However, the band length to be processed may also vary to suit the needs and, in practice, it often happens that coils of a short length, for example 300 to 400 meters, must be treated. But, the upstream accumulator located between the inlet section and the processing section must supply the processing section during a stoppage idle time in the inlet section, duration of which can not be reduced below a certain limit since it results from a succession of functions whose elementary times are linked in sequences.

However, once emptied in order to supply the processing section during the stoppage time, the accumulator must be filled again to enable connection with the next coil and, to do so, the new band is caused to run, in the inlet section, at a higher speed than the normal processing speed, for instance 600 to 800 m/mn.

If the new coil is very short, its tail may reach the inlet section before the accumulator is completely filled and, at this precise time, the running cycle must be stopped again in the inlet section to make the junction while feeding the processing section from the accumulator. If it is possible to absorb the pass of a single short coil, conversely, insufficient fillings may add up if several short coils are processed successively.

The present invention enables to solve this problem thanks to a new method and an improved plant which enable a considerable reduction in the idle time of the inlet section and, thus, a much easier management in the line of coils of different sizes. Moreover, thanks to this reduction in the inlet idle time, the invention enables to increase the actual processing speed and, thus, the productivity of the line.

The invention therefore relates, generally speaking, to a method for managing the feed of a new coil into a continuous inline processing plant of a band-type product. The plant is supplied with successive bands and includes means for controlling the continuous running of the band, successively in an inlet section, an upstream accumulator, a processing section, a downstream section and an outlet section, the connection of the tail of a first coil when completely unwound with the head of a next coil being carried out in the inlet section of the plant in two successive stage cycles, respectively a first preparation cycle for preparing the ends, respectively tail and head ends of both bands for the junction thereof and a second junction cycle for joining the two facing edges of said ends.

According to the invention, joining the facing edges of the ends of both bands is performed in at least two portions of the inlet section, respectively a first portion and a second portion, between which is located an intermediate accumulator for setting aside a variable band length, and the time necessary to perform all the connection operations of both bands is divided into at least two time periods, respectively a first time period corresponding to the first preparation cycle and to a first phase of the second junction cycle of the facing edges of both bands and a second time period corresponding to a second phase of the second junction cycle, said both time periods being separate by a time interval of variable duration corresponding to the running of the band in the intermediate accumulator of the band length set aside.

An essential idea of the invention consists therefore in breaking down the junction cycle into two separate phases, with setting aside a variable band length in an intermediate accumulator.

In a first embodiment of the invention, the junction of both bands is performed by welding in a welding machine located in the first portion of the inlet section. In such a case, the welding operation is processed at the end of the first time period in a first phase of the secon junction cycle, and the tail of the first band and its welded junction with the head of the next band is then passed into the intermediate accumulator, the running being stopped again in the second portion of the inlet section to perform at least one finishing operation during a second time period of the junction cycle.

In another embodiment of the invention, the welding machine is located in the second portion of the inlet section. In such a case, a temporary junction of the tail of the first band with the head of the next band is made at the end of the first time period of the general connection process, in a first phase of the junction cycle, and the running of the band is then resumed to bring said temporary junction into the second portion of the inlet section by passing through the intermediate accumulator, the running cycle being stopped again during the second time period of the general connection process in order to perform the welding operation itself and at least one finishing operation in a second phase of the junction cycle.

Particularly advantageously, before completion of the unwinding of the first coil, band lengths are set aside in the upstream accumulator and in the intermediate accumulator, corresponding to the maximum capacity thereof.

The method according to the invention thus enables, during the first time period of the junction process, to feed the processing section at normal speed from the upstream accumulator, and, at the same time, to pass a band length into the upstream accumulator from the intermediate accumulator capable of replacing at least one portion of the length passing into the processing section.

Moreover, during the second time period of the junction process, it is possible to supply the processing section at normal speed from the upstream accumulator and, at the same time, to control the running, in the first portion of the inlet section, of the band length necessary for restoring the intermediate accumulator to the maximum capacity thereof.

The invention also covers a perfected plant for the implementation of the method, including, as usual, an inlet section, an upstream accumulator, a processing section, a downstream section and an outlet section.

As indicated, the connection process of the tail of a coil when completely unwound with the head of a new coil is performed through successive stages in different items of equipment which are sometimes gathered in the same machine but may also be separated. For instance, to perform steps A to K described previously, the plant comprises:

- at least two uncoilers operating alternately, one for unwinding a coil under treatment and the other for unwinding the next coil, each uncoiler being associated with cropping shears;
- a device acting as a switch for threading the band coming from either of both uncoilers into the plant;
- means for positioning, for instance, band inlet lateral guides in the welding machine;
- a welding machine associated with two shearing tools or double shears for shearing of the two facing edges on the ends of both bands,
- a finishing facility, for instance a planing machine which may be integrated in the welding machine,
- positioning means such as lateral guides for the outlet of the band and for instance its inlet into a tensioner preceeding the upstream accumulator placed at the inlet of the etching section.

The invention is based on the idea that it was possible to distribute the items of equipments of the inlet section into two portions which are separated physically by an intermediate accumulator, so that the whole connection process is divided into two time periods which are separated by a time interval of variable duration.

This intermediate accumulator has a capacity corresponding at least to the band length running through the processing section at normal speed for the duration of the first time period of the connection process.

As indicated above, during the second time period of the connection process, this intermediate accumulator may supply the upstream accumulator so as to maintain it, as far as possible, at the maximum capacity thereof. So, it is possible to confer to the upstream accumulator a capacity simply corresponding to the band length running through the processing section at normal speed during the second time period of the connection process.

In particular, the invention enables to solve the problem linked with the relatively short coils. Indeed, it is possible to manage the filling rate of the intermediate accumulator relative to the length of each new coil so as to restore the maximum capacity of the upstream accumulator after each time period of the connection process.

In particular, according to a preferred feature of the invention, it is possible to insert a third coil in the inlet section as soon as the intermediate accumulator is sufficiently filled to enable to stop the running through the first portion of the inlet section, in order to join, at least temporarily, the tail of the new coil with the head of the third coil.

Thus, in a preferred embodiment of the invention, once the junction has been stopped in the second portion of the inlet section, the unwinding speed of the new coil is increased for filling, at least partially, the intermediate accumulator, so that, according to the length of the new coil, the tail thereof can be stopped in the first portion of the inlet section for its junction with the head of a third coil, after a band length corresponding at least to the first time period of the connection process having been set aside.

With such a breaking down of the global time necessary to the connection of two successive coils into at least two time periods separate by a time interval, thanks to the invention, it is possible to reduce the stoppage idle time of the unwinding of the coils in the inlet section, in practice this idle time may not exceed the longest of both time periods of the connection process.

But the invention will be understood by the following description of some particular embodiments, given for exemplification purposes and represented on the appended drawings.

FIG. 1 is a diagram indicating, by way of example, the duration of the different steps of the general connection process of two successive bands.

FIG. 2 represents schematically the inlet section of a plant, in a first embodiment of the invention.

FIG. 3 is a diagram representing the unwinding of the two time periods of the connection process relative to time.

FIG. 4 represents schematically the inlet section of a plant, in a second embodiment of the invention.

FIG. 5 is a diagram indicating, relative to time, the unwinding of the two time periods of the general connection process, in the embodiment of FIG. 4.

As indicated, FIG. 1 is a diagram representing through time the different steps A to I of the general connection process conventionally performed in the inlet section of a continuous inline processing plant.

FIG. 2 represents schematically the inlet section of a advanced plant in a first embodiment of the invention.

As usual, the band to be processed can be unwound from either of both uncoilers 11, 11', each associated with means 12, 12' for unwinding and straightening the band and with cropping shears 13, 13'. A switching device 14 enables to insert in the inlet section the band M or M' from, respectively, either of both uncoilers 11, 11'.

According to the invention, the inlet section 1 is divided into two portions 3 and 4 between which is positioned an intermediate accumulator 5. After exiting the inlet section, the band passes, as usual, through an upstream accumulator 6 and through the processing section 7, this latter being followed by a downstream section and the outlet section. The portions of the plant which follow the upstream accumulator 6 are not modified and have consequently not been represented on the drawings.

The items of equipment necessary for the junction of two successive coils are distributed between both portions 3 and 4 of the inlet section 1.

Thus, in the embodiment represented in FIG. 2, the first portion 3 of the inlet section comprises a means of temporary junction 31 such as a stapler, associated with inlet lateral guides 32 and outlet lateral guides 33.

The intermediate accumulator 5 may be conducted conventionally according to the band length to be set aside, this length being indicated below.

It is known that, generally speaking, a band accumulator is composed of a set of fixed rolls and a set of mobile rolls whereon the band passes, the mobile rolls being mounted on a carriage which may be moved so as to vary the band length accumulated. The band should remain stretched between the fixed and mobile rolls and therefore such an accumulator should be normally associated with two tensioners, for instance with S-shaped rolls placed respectively upstream and downstream of the accumulator in the running direction.

In FIG. 2, the intermediate accumulator 5 is shown schematically as a mobile roll 51 and two tensioners, respectively upstream 52 and downstream 53 tensioners.

The second portion 4 of the inlet section 1 comprises, as usual, a welding tool 41, for instance a flash welding tool, associated with double shears 42 and with a planer 43. In FIG. 2, these items of equipment are represented separately but it is known that they may advantageously be gathered in the same machine. By way of example, the French patent 2 756 504 belonging to the same company describes a flash welding machine including two pairs of clamping jaws of the ends of both bands M, M' to be connected, which are mounted respectively on a fixed frame and on a mobile frame, double shears formed for instance of two pairs of blades or wheels moveable transversally for shearing the ends of both bands along two parallel lines and a plane tool mounted slidingly and transversally on the fixed frame.

Besides, the welding machine is associated, usually, with inlet and outlet lateral guides 44, 45 which enable to obtain an accurate positioning of both bands M, M' in the machine, in particular for shearing and bringing closer the ends to be welded.

The upstream accumulator 6 may be realised in any known fashion and has therefore been represented schematically in FIG. 2 by a simple mobile roll 61 associated with two tensioners 62, 63.

The plant represented in FIG. 2 enables therefore to share the connection process into two successive time periods carried out respectively in both portions 3 and 4 of the inlet section.

The diagram of FIG. 3 represents, relative to the time indicated in abscissa, the successive steps of the general connection process of both bands, in a plant as represented in FIG. 2 and including, consequently, two successive time periods separates by a time for passing through the intermediate accumulator 5.

As indicated, the first section 3 of the plant differs from a conventional plant in that the electric welding machine is replaced with a means for a temporary junction such as a stapler 31. The first time period of the connection process comprises therefore, on the one hand, the steps A, B, C, D, E of the preparation cycle P corresponding, as said above with reference to FIG. 1, to the cutting of the tail of the band during unwinding, the introduction of the following band cut beforehand and the positioning of both bands into the stapler and, on the other hand, two new steps L and M.

Indeed, in a step L, both bands are stapled. This operation is quicker than the welding process and may involve, for instance, 5 seconds.

Both bands being thus joined temporarily, the running is resumed in a starting step M which may last 5 seconds.

Hence, both steps L and M form a first phase $S_1$ of the junction cycle taking place in the first time period of the connection process.

Thus, for this first time period, the global stoppage time $T_1$ of the running in the first portion 3 of the inlet section may be of the order of 50 seconds.

During this stoppage time $T_1$, the processing section has been supplied by the upstream accumulator 7 but, according to an essential feature of the invention, said accumulator has been supplied in turn from the intermediate accumulator 5 so as to be maintained substantially at the maximum capacity thereof.

The capacity of the intermediate accumulator 5 should hence correspond at least to the band length running at the normal processing speed during the first stoppage time $T_1$.

The tail of the first band restored to its running speed is joined temporarily to the head of the new band and passes therefore through the intermediate accumulator 5 to reach the second portion 4 of the inlet section. Since, at that time, the intermediate accumulator 5 has a reduced capacity, the running time $T_2$ of the temporary junction in this intermediate accumulator may be rather short, for instance, 25 seconds.

The second phase $S_2$ of the junction cycle may then be carried out in the second portion 4 of the inlet section.

The temporary junction should be, first of all, positioned in the welding machine in a step E' which may require 10 seconds. The ends of both bands being held by the clamping jaws of the welding machine, processing step F' allows to shear both edges with discharging of the staple, and step G to weld said edges.

Finishing operations are then conducted, such as planing the welded spot (step H), before returning to the normal speed (step I).

This second time period of the connection process requires a global stoppage time $T_3$ in the second portion 4 of the inlet section which may be of the order of 45 seconds.

Obviously, as indicated with reference to FIG. 1, this time may be lengthened if the weld is notched (step J) and/or annealed (step K).

A the end of step I or K, the running of the band may resume at normal speed but the upstream accumulator 6 which has supplied the processing section, should be restored to the maximum capacity thereof. To do so, the running speed in the inlet section 1 is increased, for instance, to 700 or 800 m/mn during the time necessary for filling the accumulator.

However, the running should be stopped when the tail of this new coil reaches the beginning of the inlet section 1 and, if the length of this new coil is too small, this event may happen before the upstream accumulator 6 is completely filled.

The method which has just been described enables to avoid such a shortcoming thanks to the breakdown of the connection process into two time periods realised in two different portions 3, 4 of the inlet section 1 and separated with a time interval $T_2$ of variable duration.

Indeed, the global stoppage time of the running necessary for connecting two successive bands is divided into two time periods and, consequently, the time during which the processing section 7 is to be supplied by the upstream accumulator 6, is equal either to the stoppage time $T_1$ in the first portion 3 of the inlet section, or to the stoppage time $T_2$ in the second portion 4.

Besides, the intermediate accumulator 5 may maintain the upstream accumulator 6 at the maximum capacity thereof during the stoppage time $T_1$ in the first portion 3 and may then be filled during the stoppage time $T_3$ in the second portion 4 of the inlet section so as to be at the maximum capacity thereof when the tail of the new band reaches the first portion 3. Hence, multiple possibilities of managing the running of the band are available relative to the length of the coils to be integrated into the line and according to the respective capacities of the intermediate accumulator 5 and of the upstream accumulator 6.

For instance, as represented in FIG. 3, the tail of the new coil integrated into the line reaches the beginning of the inlet section 1 at instant $t_4$. Such instant $t_4$ is offset by a time $T_4$ relative to instant $t_1$ when the head of the new band M' had left the first portion 3 of the inlet section 1, after its temprary junction with the tail of the previous band M. Such time $T_4$ depends therefore on the length of the new coil.

Thanks to the use, according to the invention, of an intermediate accumulator 5, it is possible to stop again the running in the first portion 3 to realise the junction with a third coil, as soon as the intermediate accumulator 5 has a sufficient capacity to maintain the running downstream during the time $T_1$.

In practice, from the instant $t_1$ when the head of the new band M' is joined with the previous band M, the running speed may be increased in the first portion 3 in order to fill the intermediate accumulator 5. The time necessary to that filling corresponds therefore to the minimum duration of the offset $T_4$ between the respective passages of the head and the tail of the new coil, which depends on the length thereof.

If required, for integrating a short coil, it is therefore possible to manage the operation of the accumulators 5, 6 so that the junction with a third coil starts even before instant $t_3$, i.e. before the end of the second time period $T_3$ of the connection process. Both time periods may, indeed, overlap each other since they are realised in two different portions of the inlet section 1 separate by the intermediate accumulator 5.

Besides, the invention is not limited to the single embodiment which has just been described, but may be subjected to variations, for instance for the distribution of the items of equipment between both portions of the inlet section.

Thus, in another embodiment represented in FIG. 4, the welding machine 41 is placed in the first portion 3 of the inlet section 1, upstream of the intermediate accumulator 5. In such a case, no temporary junction is necessary and the stapler 31 of FIG. 2 is suppressed, the tail of the band M once completely unwound being welded electrically to the head of the new band M'. As usual, the welding machine 41 may be fitted with double shears 42 enabling to realise, on the ends of both bands, two parallel edges which are then brought together for flash welding purposes.

Conversely, to reduce the stoppage time in this first portion 3 of the inlet section 1, the planing operation is postponed, a planer 43' being installed downstream of the intermediate accumulator 5, in the second portion 4 of the inlet section 1. Indeed, it is possible to pass, for instance at reduced speed, the flange formed by the electrical welded spot of the ends of both bands M, M' through the accumulator 5.

Therefore such an arrangement requires the installation of a separate planer 43' but enables, conversely, to suppress the stapler. Moreover, if needed, it is easier to integrate in the second portion 4 of the inlet section a notching device 46 and an annealing furnace 47.

The diagram of FIG. 5 specifies the durations of the different steps of the junction process in the case of a plant according to FIG. 4.

Since the welding machine 41 is placed, with the cropping tool 42, in the first portion 3 of the inlet section, the different steps A, B, C, D, E, F, G, of the welding process are the same ones as in the conventional method illustrated in FIG. 1. Conversely, the planing cycle is postponed and, after welding the facing ends of both bands, one may initiate, in a step M, the re-start of the line for returning to the normal speed.

The general connection process illustrated in FIG. 5 still comprises therefore a preparation cycle P corresponding to steps A to E and a junction cycle divided into two separate phases separated by passing through the intermediate accumulator 5, respectively a first phase $S_1$ corresponding to steps F, G, M and carried out in the first time period of the process and a second phase $S_2$ corresponding to steps N, H, I and, possibly J and K.

Since both bands are joined on a permanent basis and not by simple stapling, the global duration $T'_1$ of this first time period of the junction cycle is slightly greater than the first time period in the case of FIG. 3, and may be of the order of 60 to 65 seconds.

As previously mentioned, the running having resumed, the welded junction passes through the intermediate accumulator 5 and reaches the second portion 4 of the inlet section at an instant t'2, the passage time $T'_2$ can simply be around 20 or 25 seconds inasmuch as the intermediate accumulator 5 has reduced capacity at that moment.

The running of the band being stopped again, the welded sport must be positioned in the planer 43' (step N), then the planning operation is performed in step H.

As indicated above, such an embodiment is particularly advantageous if one wishes to notch (step J) and anneal (step K).

In such a case, the duration $T'_1$ of the first welding time period may be greater than the duration $T'_3$ of the second planing time period but is, anyway, very smaller than the global time necessary previously for the junction. Moreover, the intermediate accumulator 5 enables to replace, at least partially, the band length supplied with the upstream accumulator 6 during the time $T'_3$ and, thus, to maintain the latter at its optimum capacity.

It appears that the invention exhibits numerous advantages since it provides very high flexibility when managing the plant.

Still, such a plant requires the adjunction of an intermediate accumulator, but the cost of this item of equipment is quickly compensated for by an increased productivity of the plant whose load plan may be established much more flexibly thanks to the possibility of integrating the coils with variable length, even very short ones. In particular, inasmuch as both time periods of the junction process are entirely separate, one may contemplate, in the case of a very short coil, to locate the head and the tail thereof at the same time inside the intermediate accumulator, whereas both portions 3, 4 of the inlet section 1 are occupied by different bands.

Other variations would also be possible, for instance, by using another intermediate accumulator in order to divide the junction process into three time periods.

Besides, the invention applies especially to the continuous etching lines of steel bands but might also be adapted to other continuous line treatments.

The invention claimed is:

1. A method for managing the feed of a new coil into a continuous inline processing plant for making a band-type product from metal coils, said plant being supplied with successive bands and including means for controlling the continuous running of the band successively into an inlet section, an upstream accumulator, a processing section, a downstream section and an outlet section, the connection of the tail of a first coil when completely unwound with the head of a consecutive next coil being carried out in the inlet section of the plant in two successive stage cycles, respectively a first preparation cycle for preparing the ends, respectively said tail of said first coil and said head of said consecutive next coil for their junction thereof and a second junction cycle for joining both facing edges of said ends, wherein the running of the band is stopped or, at least, slowed down in the inlet section for a period of time necessary to carry out all the connection operations, and the processing section is supplied, during the stoppage time, with a band length set aside beforehand in the upstream accumulator for carrying on the process at a normal running speed, characterized in that joining the facing edges of said ends is performed in at least two portions of the inlet section, respectively a first portion and a second portion, between which is located an intermediate accumulator for setting aside a variable band length, and that the time period necessary to perform all the connection operations of said ends is divided into at least two time periods respectively a first time period corresponding to the first preparation cycle and to a first phase of the second junction cycle of the facing edges of said ends, and a second time period corresponding to a second phase of the second junction cycle, said both time periods being separate by a time interval of variable duration corresponding to the running of the band length set aside in the intermediate accumulator wherein both the first phase and the second phase of the second junction cycle comprise welding.

2. The method according to claim 1, wherein the junction of both bands is performed by welding in a welding machine, the second junction cycle of the facing edges of the ends of both bands including a welding operation followed by at least one finishing operation of the welded junction, characterized in that the welding machine is located in the first portion of the inlet section, the welding operation being processed at the end of the first time period in a first phase of the second junction cycle, and that the tail of the first band and its welded junction with the head of the next band is then passed in the intermediate accumulator, the running being stopped again in the second portion of the inlet section to perform at least one finishing operation during a second time period of the second junction cycle.

3. The method according to claim 1, wherein the junction of both bands is performed by welding in a welding machine, the second junction cycle of the facing edges of the ends of both bands including a welding operation followed by at least one finishing operation of the welded junction, characterized in that the welding machine is located in the second portion of the inlet section, that, in a first phase of the second junction cycle, the tail of the first band is temporarily joined with the head of the next band at the end of the first time period-of the general connection process, and that the running of the band is then resumed to bring said temporary junction into the second portion of the inlet section by passing through the intermediate accumulator, the running being stopped again during the second time period of the general connection process in order to perform the welding operation itself and at least one finishing operation in a second phase of the second junction cycle.

4. The method according to claim 1, characterized in that, before completion of the unwinding of the first coil, band lengths are set aside in the upstream accumulator and in the intermediate accumulator, corresponding to the maximum capacity thereof.

5. The method according to claim 4, characterized in that, during the first time period of the general connection process, the processing section is supplied at normal speed from the upstream accumulator, and that, at the same time, the passage, into the upstream accumulator from the intermediate accumulator, of a band length able to replace at least one portion of the length passing into the processing section is controlled.

6. The method according to claim 1, characterized in that, during the second time period of the general connection process, the processing section is supplied at normal speed from the upstream accumulator, and that the running, through the first portion of the inlet section, of the band length necessary for restoring the intermediate accumulator to the maximum capacity thereof, is controlled.

7. The method according to claim 5, characterized in that the intermediate accumulator has a capacity corresponding at least to the band length running through the processing section at the normal speed for the duration of the first time period of the general connection process.

8. The method according to claim 7, characterized in that, once the junction has been stopped in the second portion of the inlet section, the unwinding speed of the new coil is increased for filling, at least partially, the intermediate accumulator, so that, according to the length of the new coil, the tail thereof can be stopped in the first portion of the inlet section for the junction thereof with the head of a third coil, after setting aside a band length corresponding at least to the first time period of the general connection process.

9. The method according to claim 5, characterized in that the upstream accumulator has a capacity corresponding at least to the band length running through the processing section at normal speed during the second time period of the general connection process.

10. The method according to claim 1, characterized in that the filling rate of the intermediate accumulator is managed relative to the length of each new coil so as to restore the upstream accumulator to the maximum capacity thereof after each time period of the general connection process.

11. The method according to claim 1, characterized in that, at the end of the second time period of the general connection process, the welding spot is annealed.

12. The method according to claim 2, characterized in that, before completely unwinding the first coil, band lengths are set aside in the upstream accumulator and in the intermediate accumulator, corresponding to the maximum capacity thereof.

13. The method according to claim 3, characterized in that, before completely unwinding the first coil, band lengths are set aside in the upstream accumulator and in the intermediate accumulator, corresponding to the maximum capacity thereof.

14. The method according to claim 12, characterized in that, during the first time period of the general connection process, the processing section is supplied at normal speed from the upstream accumulator, and that, at the same time, the passage, into the upstream accumulator from the intermediate accumulator, of a band length able to replace at least one portion of the length passing into the processing section is controlled.

15. The method according to claim 13, characterized in that, during the first time period of the general connection process, the processing section is supplied at normal speed from the upstream accumulator, and that, at the same time, the passage, into the upstream accumulator from the intermediate accumulator, of a band length able to replace at least one portion of the length passing into the processing section is controlled.

16. The method according to claim 12, characterized in that, during the second time period of the general connection process, the processing section is supplied at normal speed from the upstream accumulator, and that the running, through the first portion of the inlet section, of the band length necessary for restoring the intermediate accumulator to the maximum capacity thereof, is controlled.

17. The method according to claim 13, characterized in that, during the second time period of the general connection process, the processing section is supplied at normal speed from the upstream accumulator, and that the running, through the first portion of the inlet section, of the band length necessary for restoring the intermediate accumulator to the maximum capacity thereof, is controlled.

18. The method according to claim 14, characterized in that the intermediate accumulator has a capacity corresponding at least to the band length running through the processing section at the normal speed for the duration of the first time period of the general connection process.

19. The method according to claim 15, characterized in that the intermediate accumulator has a capacity corresponding at least to the band length running through the processing section at the normal speed for the duration of the first time period of the general connection process.

20. The method according to claim 6, characterized in that the intermediate accumulator has a capacity corresponding at least to the band length running through the processing section at the normal speed for the duration of the first time period of the general connection process.

21. The method according to claim 16, characterized in that the intermediate accumulator has a capacity corresponding at least to the band length running through the processing section at the normal speed for the duration of the first time period of the general connection process.

22. The method according to claim 17, characterized in that the intermediate accumulator has a capacity corresponding at least to the band length running through the processing section at the normal speed for the duration of the first time period of the general connection process.

23. The method according to claim 18, characterized in that, once the junction has been stopped in the second portion of the inlet section, the unwinding speed of the new coil is increased for filling, at least partially, the intermediate accumulator, so that, according to the length of the new coil, the tail thereof can be stopped in the first portion of the inlet section for the junction thereof with the head of a third coil, after setting aside a band length corresponding at least to the first time period of the general connection process.

24. The method according to claim 19, characterized in that, once the junction has been stopped in the second portion of the inlet section, the unwinding speed of the new coil is increased for filling, at least partially, the intermediate accumulator, so that, according to the length of the new coil, the tail thereof can be stopped in the first portion of the inlet section for the junction thereof with the head of a third coil, after setting aside a band length corresponding at least to the first time period of the general connection process.

25. The method according to claim 20, characterized in that, once the junction has been stopped in the second portion of the inlet section, the unwinding speed of the new coil is increased for filling, at least partially, the intermediate accumulator, so that, according to the length of the new coil, the tail thereof can be stopped in the first portion of the inlet section for the junction thereof with the head of a third coil, after setting aside a band length corresponding at least to the first time period of the general connection process.

26. The method according to claim 21, characterized in that, once the junction has been stopped in the second portion of the inlet section, the unwinding speed of the new coil is increased for filling, at least partially, the intermediate accumulator, so that, according to the length of the new coil, the tail thereof can be stopped in the first portion of the inlet section for the junction thereof with the head of a third coil, after setting aside a band length corresponding at least to the first time period of the general connection process.

27. The method according to claim 22, characterized in that, once the junction has been stopped in the second portion of the inlet section, the unwinding speed of the new coil is increased for filling, at least partially, the intermediate accumulator, so that, according to the length of the new coil, the tail thereof can be stopped in the first portion of the inlet section for the junction thereof with the head of a third coil, after setting aside a band length corresponding at least to the first time period of the general connection process.

28. The method according to claim 14, characterized in that the upstream accumulator has a capacity corresponding at least to the band length running through the processing section at normal speed during the second time period of the general connection process.

29. The method according to claim 15, characterized in that the upstream accumulator has a capacity corresponding at least to the band length running through the processing section at normal speed during the second time period of the general connection process.

30. The method according to claim 6, characterized in that the upstream accumulator has a capacity corresponding at least to the band length running through the processing section at normal speed during the second time period of the general connection process.

31. The method according to claim 16, characterized in that the upstream accumulator has a capacity corresponding at least to the band length running through the processing section at normal speed during the second time period of the general connection process.

32. The method according to claim 17, characterized in that the upstream accumulator has a capacity corresponding at least to the band length running through the processing section at normal speed during the second time period of the general connection process.

33. The method according to claim 1, which comprises: running the band at a normal running speed of 400 m/min to 600 m/min.

* * * * *